US005483881A

United States Patent [19]

Erman

[11] Patent Number: 5,483,881

[45] Date of Patent: Jan. 16, 1996

[54] METHOD AND APPARATUS FOR CONTROLLING MULTI-STATION SCREEN PRINTERS

[75] Inventor: Alex Erman, Chicago, Ill.

[73] Assignee: American Screen Printing Equipment Co., Chicago, Ill.

[21] Appl. No.: 607,429

[22] Filed: Oct. 31, 1990

[51] Int. Cl.[6] ..... B41F 15/18

[52] U.S. Cl. ..... 101/126; 101/115; 101/474; 101/129

[58] Field of Search ..... 101/115, 123, 101/124, 126, 129, 40, 43, 44, 474

[56] References Cited

U.S. PATENT DOCUMENTS 3,812,779 5/1974 Cobb ..... 101/115
5,383,400 1/1995 Szyszko ..... 101/126

OTHER PUBLICATIONS

Advertisement dated Dec., 1990 entitled, "Names To Trust From M & R—The Eliminator—The GT-8 Gauntlet," from M & R Printing Equipment, Inc.

*Primary Examiner*—Ren Yan
*Attorney, Agent, or Firm*—Fitch, Even, Tabin & Flannery

[57] ABSTRACT

A screen printing apparatus comprising a plurality of print stations arranged in a circle and an equal plurality of platens carrying objects to be printed by the print stations. Objects to be printed are placed on platens at a loading/unloading one of the stations and the platens are indexed around the circle of print stations for printing. A control unit controls the printing at the print stations and selectively inhibits printing at individual ones of the print stations. During start up, the control unit activates print stations, one at a time, in synchronism with the indexing of the platens. A skip mode is available in which printing at a given platen is inhibited by the control unit at each print station, when the given platen is at that print station. The control unit also successively inhibits print stations, one at a time, in synchronism with platen indexing to provide a controlled stop of the apparatus.

13 Claims, 6 Drawing Sheets

FIG. 8

206

| INPUT | STATION NUMBER 1 | 2 | 3 | 4 | 5 | 6 | 7 | 8 | 9 | 10 | PRINT CYCLE |
|---|---|---|---|---|---|---|---|---|---|---|---|
| 0 → | 1 | 0 | 0 | 0 | 0 | 0 | 0 | 0 | 0 | 0 | 1 |
| 0 → | 0 | 1 | 0 | 0 | 0 | 0 | 0 | 0 | 0 | 0 | 2 |
| 0 → | 0 | 0 | 1 | 0 | 0 | 0 | 0 | 0 | 0 | 0 | 3 |
| 0 → | 0 | 0 | 0 | 1 | 0 | 0 | 0 | 0 | 0 | 0 | 4 |
| 0 → | 0 | 0 | 0 | 0 | 1 | 0 | 0 | 0 | 0 | 0 | 5 |
| 0 → | 0 | 0 | 0 | 0 | 0 | 1 | 0 | 0 | 0 | 0 | 6 |
| 0 → | 0 | 0 | 0 | 0 | 0 | 0 | 1 | 0 | 0 | 0 | 7 |
| 0 → | 0 | 0 | 0 | 0 | 0 | 0 | 0 | 1 | 0 | 0 | 8 |
| 0 → | 0 | 0 | 0 | 0 | 0 | 0 | 0 | 0 | 1 | 0 | 9 |
| 0 → | 0 | 0 | 0 | 0 | 0 | 0 | 0 | 0 | 0 | 1 | 10 |

FIG. 9

206

| INPUT | STATION NUMBER 1 | 2 | 3 | 4 | 5 | 6 | 7 | 8 | 9 | 10 | PRINT CYCLE |
|---|---|---|---|---|---|---|---|---|---|---|---|
| 1 → | 1 | 0 | 0 | 0 | 0 | 0 | 0 | 0 | 0 | 0 | 1 |
| 1 → | 1 | 1 | 0 | 0 | 0 | 0 | 0 | 0 | 0 | 0 | 2 |
| 1 → | 1 | 1 | 1 | 0 | 0 | 0 | 0 | 0 | 0 | 0 | 3 |
| 1 → | 1 | 1 | 1 | 1 | 0 | 0 | 0 | 0 | 0 | 0 | 4 |
| 1 → | 1 | 1 | 1 | 1 | 1 | 0 | 0 | 0 | 0 | 0 | 5 |
| 1 → | 1 | 1 | 1 | 1 | 1 | 1 | 0 | 0 | 0 | 0 | 6 |
| 1 → | 1 | 1 | 1 | 1 | 1 | 1 | 1 | 0 | 0 | 0 | 7 |
| 1 → | 1 | 1 | 1 | 1 | 1 | 1 | 1 | 1 | 0 | 0 | 8 |
| 1 → | 1 | 1 | 1 | 1 | 1 | 1 | 1 | 1 | 1 | 0 | 9 |
| 1 → | 1 | 1 | 1 | 1 | 1 | 1 | 1 | 1 | 1 | 1 | 10 |

METHOD AND APPARATUS FOR CONTROLLING MULTI-STATION SCREEN PRINTERS

BACKGROUND OF THE INVENTION

This invention relates to screen printing, and especially to the control of screen printing apparatus which is designed for multiple-impression screen printing on a relatively high production basis.

For volume production of multiple printed copies, it is necessary that the object being printed be moved quickly from station to station in a multiple station printing apparatus, and necessary, if not critical, that the registration of the object to be printed with a particular printing screen in a progression of printing screens be maintained with reasonable accuracy. For this purpose, it has heretofore been proposed that the objects to be printed, or multiple such objects, be placed upon platens which are carried by a turntable in a circular path beneath a circular array of printing heads each located one indexing step distant from the next, with one or more stations left vacant for the unloading of the printed object from the platen and its replacement with yet another object to be printed.

It has, however, been found that certain screen printing operations do not always lend themselves to a neatly ordered time sequence of printing steps. Due largely to the difference in drying times of the varieties and amounts of inks used for screen printing, certain printing locations are not equipped with a printer, but are used to provide additional ink drying time or are equipped with heaters to cure the ink.

Currently, purchasers of multi-color screen printing apparatus purchase equipment with a larger number of printing heads than the actual number of different colors they intend to print. This is because the different artwork and the different substrates being printed require the ability to print at each sequential location and to be able to use a flash cure unit at each of these sequential locations. Additionally, the heat imparted to the ink and substrate at a flashing may interfere with the next immediate printing, because only a very short period of time has elapsed, e.g., 6–10 seconds for the ink and substrate to cool. To allow for more cooling, the station following the flashing station is left open and the printing head thereat is disabled. In large color applications such as printing with eight color, two or more flashes of ink with a subsequent cooling may be used. In order to print three or four colors, printers will often buy a six color or six head machine in order to have the flexibility to print, flash and cool at the six different stations.

After the printing apparatus is configured with the desired number of print heads, curing stations and drying stations, an operator at the loading/unloading station removes printed articles from the platens and replaces them with new articles to be printed. Should an article not be placed on a platen, the empty platen will sequence through the printing steps and be printed instead of the article. Similarly, should an article be improperly placed on the loading/unloading platen, the article will be improperly printed and its value will be destroyed. To avoid the obvious cleanup required if the platen itself is printed or to avoid printing errors caused by printing a misplaced article, a stop button can be provided which stops the indexing of the apparatus before printing occurs. Restarting the machine after a stop is difficult, since the timing relationships of the printing, drying and cooling Steps cannot always be re-achieved for partially printed articles. Accordingly, stopping and restarting the apparatus can result in lost articles.

A need exists for a multiple head printer apparatus in which the individual print heads of the apparatus can be selectively controlled on a transitory basis to inhibit printing on a given platen when doing such would produce undesired results.

SUMMARY OF THE INVENTION

The present invention provides control for a multi-print station printing apparatus whereby individual object carrying platens can be selectively marked as non-printing platens and as the non-printing platens progress through the print stations printing is inhibited for them while permitted for platens before and after. The ability to "skip" the printing at one or more of the platens while printing at the other platens solves the improper printing problems of prior arrangements.

A screen printing apparatus in accordance with the present invention includes a plurality of platens for conveying objects to be printed, an input station for placing the objects on the platens, a plurality of print stations, each for printing an impression on the platen carried objects and means for incrementing the platens from the input station to the print stations. Importantly included in this apparatus are arrangements for marking a platen or platens as non-printing and a controller responsive to the non-printing platen status for inhibiting printing by the print stations on the non-print platens.

The controller stores for each identified non-print platen a non-print platen representation which in response to platen movements is temporarily associated with different ones of said print stations in synchronism with platen movements. The controller inhibits the print operation by any print station which is associated in the control means with a non-print representation.

The selective inhibition of printing by print stations is used in three primary printing functions. When printing is to begin, all platens are identified and represented as non-print platens. Platens represented as non-print are not printed on until after they pass the loading station. Platens which are incrementally moved from the loading station to the print stations are not represented as non-print platens and accordingly, are printed as they progress through the apparatus. This function causes all empty platens to not be printed on until they have had the opportunity to receive an object to be printed at the loading station.

A second control function made possible by selective print station control is that of platen skipping which is initiated, for example, when an empty platen or a platen bearing a misplaced work object is about to be presented to the printing stations. Platen skipping begins when an operator presses a skip button, causing the platen at the loading station to be marked as a non-print platen. The non-print status is stored in the control unit and reassociated after each incremental movement with successive ones of the print stations. Whenever a print station is associated by the control unit with a platen having a non-print status mark, control signals which are necessary to operate the print station are inhibited thereby inhibiting printing at that print station. A non-print platen moves from station to station through the print apparatus without being printed. When the non-print platen moves from the last print station to the loading station, its non-print status is deleted from the control unit so that during subsequent passes through the printing apparatus, the formerly non-print platen can be printed.

The selective print station control of the present invention is also employed to provide a controlled stop for the printing apparatus. Upon the pressing of a stop button, each platen moving from the loading station to the first print station is marked as a non-print platen. This effectively turns the print stations off in sequence and in synchronism with incremental platen movements of the platens. When the number of incremental movements equals the total number of stations in the printing apparatus, the printing of all work objects is completed the incremental movements of the platens is terminated.

The present invention also includes the ability to selectively inhibit print stations from receiving print control signals on a semi-permanent basis. Such ability which is achieved by throwing one switch per inhibited print station, simplifies the control of reconfigurable multi-station printing apparatus. When a print station is not to be used, it can simply be turned off by cooperative interaction of the operator controllable switches and the control unit. In a later configuration of print heads, the previously inhibited print station can be enabled again by similar cooperative action between the switches and the control unit.

BRIEF DESCRIPTION OF THE DRAWINGS

FIG. 8 is a functional representation of the control of print head inhibit signals in the performance of a skip platen function; and FIG. 9 is a functional representation of the control of print head inhibit signals in the performance of a stop function.

DETAILED DESCRIPTION OF THE PREFERRED EMBODIMENT

Figure 1:
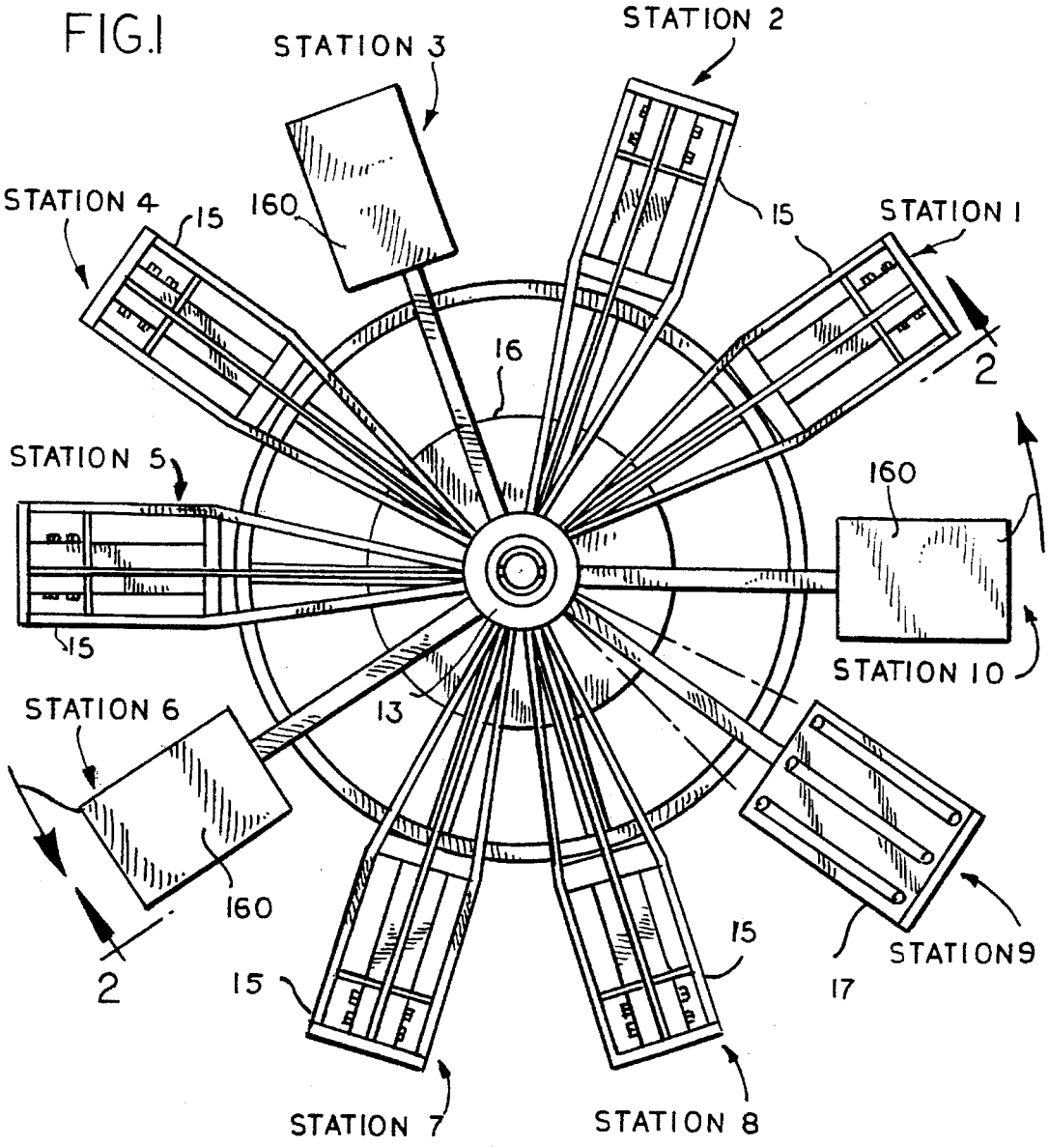
FIG. 1 is a diagrammatic plan view of a turntable served multiple screen printing apparatus in accordance with the invention.

FIG. 1 is a top view of a screen printing apparatus embodying the present invention. The apparatus includes a turntable 16 to which ten platens 160 are attached with equal angular spacing between them. Turntable 16 is periodically (6 to 10 seconds) rotated counterclockwise about a central column 13 by one-tenth of a revolution (36°). After each incremental rotation, turntable 16 pauses briefly for a printing activity. Each point that the platens 160 stop after each rotation is called a station, and the act of rotating the turntable 16 is called indexing. Accordingly, ten stations labeled station 1 through station 10 exist in sequence around the apparatus of FIG. 1.

In the present apparatus, a print heads 15 are attached above stations 1, 2, 4, 5, 7 and 8, curing apparatus 17 is placed above station 9 and stations 3, 6 and 10 are left open. Open stations 3 and 6 are provided to allow extra ink drying times between stations 2 and 4 and stations 5 and 7, respectively. At station 10, which is referred to as the input station, printed objects are removed from the platens 160 of the apparatus and new unprinted objects are placed on the platens for sequential application to the printing, drying and curing stations. The rotation of platens 160 is done in controlled increments. During each incremental movement, the turntable is indexed from one station to the next and raised to bring the objects to be printed into registered contact with the print heads 15. After printing, the turntable of platens is lowered and indexed to the next counterclockwise station.

Figure 2:
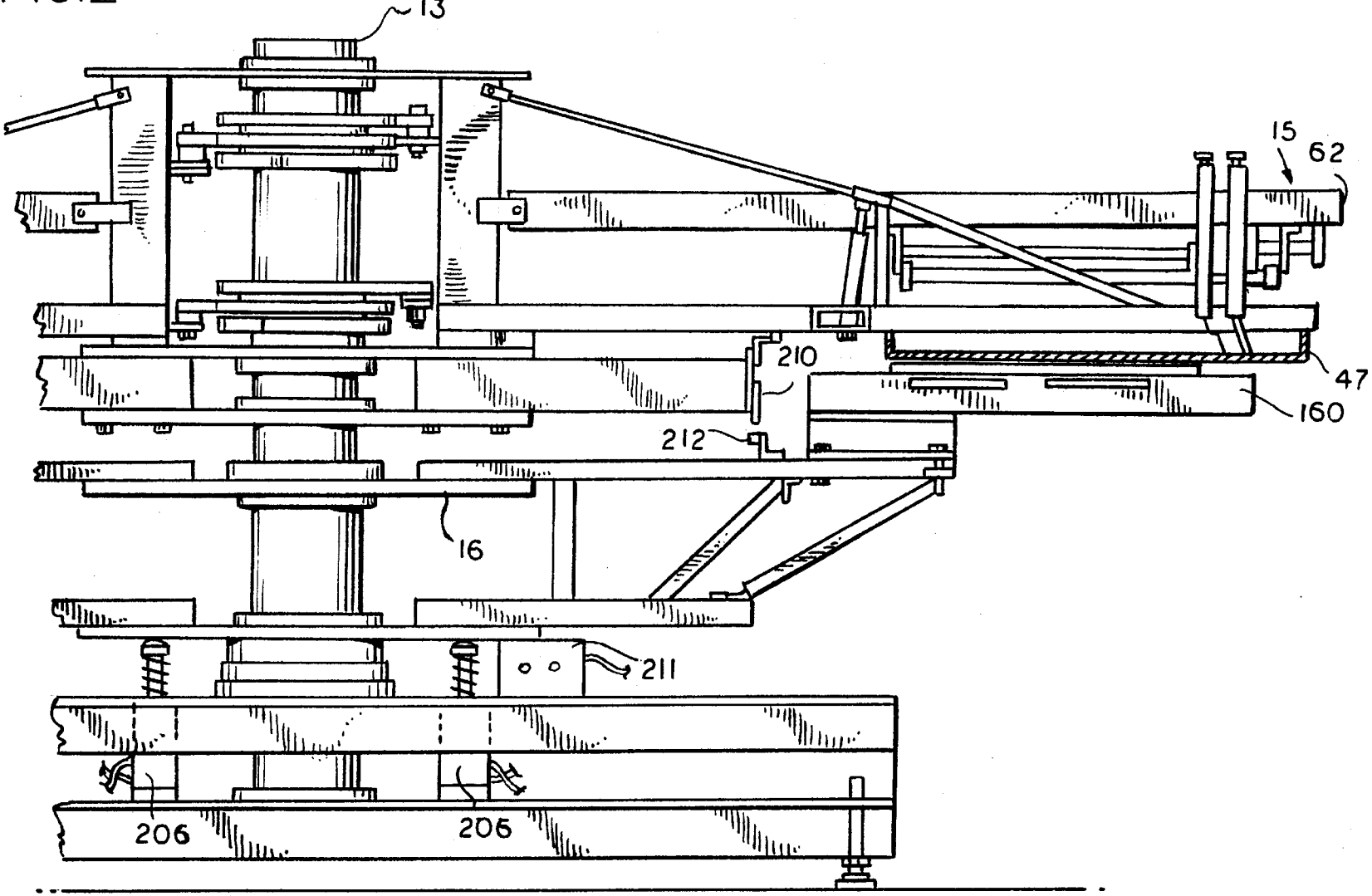
FIG. 2 is a fragmentary elevational view of the apparatus shown schematically in FIG. 1.

FIG. 2 is a sectional view of the printing apparatus of FIG. 1 taken along line 2—2 which is intended to show the relationships of turntable 16, platens 160 and print heads 15. In the present embodiment, each print operation begins with a 36° index movement caused by the operation of a pneumatic indexer 211. Indexer 211 operates in response to control signals discussed later. At the completion of an index, each platen 160 is at one of the ten stations and the platen 160 at station 1 is aligned with a print head 15. The turntable 16 is then raised by a pair of pneumatically driven cylinders 206 so that an object on platen 160 is brought into contact with the print screen 47 of print head 15. As the turntable 16 is raised, a plurality of roller cam followers 212 mounted to the turntable engage in equal plurality of stationary downwardly opened locating forks 210, thus locking the turntable 16 in printing position with its numerous platens 160 appropriately positioned at their respective stations. At the raising of turntable 16, printing by the print head begins.

Figure 3:
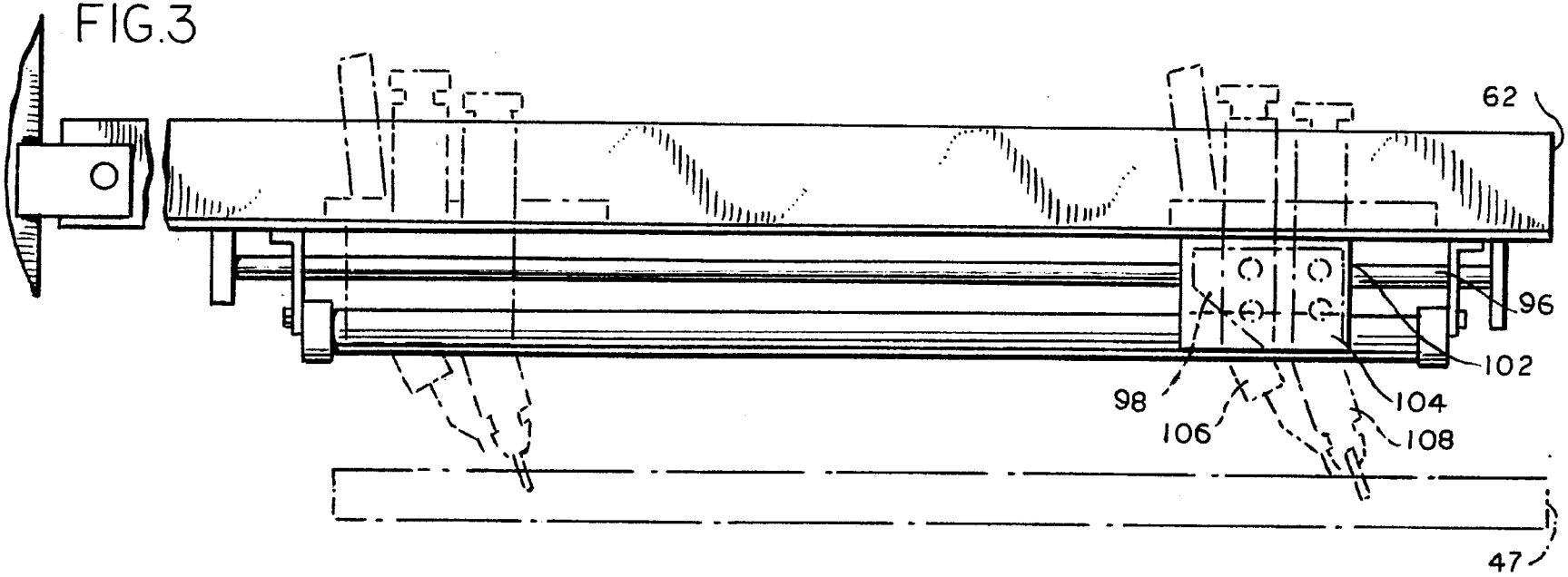
FIG. 3 is an enlarged fragmentary elevational view of the travelling ink spreading and squeegee apparatus of the screen printer of FIG. 2.

The print head 15 proper, underslung from a lift beam 62 at its outer end, is shown in some detail in FIG. 3. Essentially, it comprises a recipricable carriage 98 mounted by means of Thompson linear bearings upon a pair of round shafts 96 supported by brackets from a plate secured to the underside of the lift beam. Carriage 98 is driven along its two mounting shafts 96 by means of a rodless air cylinder, the moveable carriage of which is secured to the underside of the print head carriage 98. Mounted on each side of the carriage is a plate 104 which supports the two active members of the printing head, namely, the ink flood bar 106 and the printing squeegee 108. The driving force for the selective positioning of the two active members is a double-acting air cylinder, which also serves to maintain one or the other in its lowered active position. The printing assembly is shown twice in FIG. 3 to represent its range of travel. In the non-printing state, the printer assembly is on the left of FIG. 3. When printing is to begin, flood bar 106 is lowered and squeegee 108 is raised. The carriage is then moved outwardly (left-to-right) with the flood bar distributing the ink evenly over print screen 47. When the carriage is at its right most position as shown in FIG. 3, flood bar 106 is raised and squeegee 108 is lowered. The return of the carriage to the left most position while squeegee 108 is lowered completes the printing step.

The operation and mechanical structure of the printing apparatus of FIGS. 1 through 3 is more fully described in copending application Ser. No. 592,037 entitled "Rotatable Multi-Color Screen Printing Apparatus," filed Oct. 3, 1990.

Print heads 15, indexer 211 and registration cylinders 206 are pneumatically driven. The drive for these operations is controlled by electrical signals operating through electrically controlled gas pressure valves (not shown). The electrical signals are generated by a control unit 50 shown in FIG. 5. Representations of the electrical signals themselves are shown in FIG. 4, which is a general timing diagram representing the sequence of system operations.

Control unit 50 generates the electrical signals for indexing and registering turntable 16, as well as for controlling printing by each of print heads 15. In a preferred embodiment, control unit 50 is an Omron, programmable logic controller Model SYSMAC C200H which performs all of the functions shown as separated blocks in control unit 50. The functions have been separated in the drawing for ease of understanding.

Figure 4:
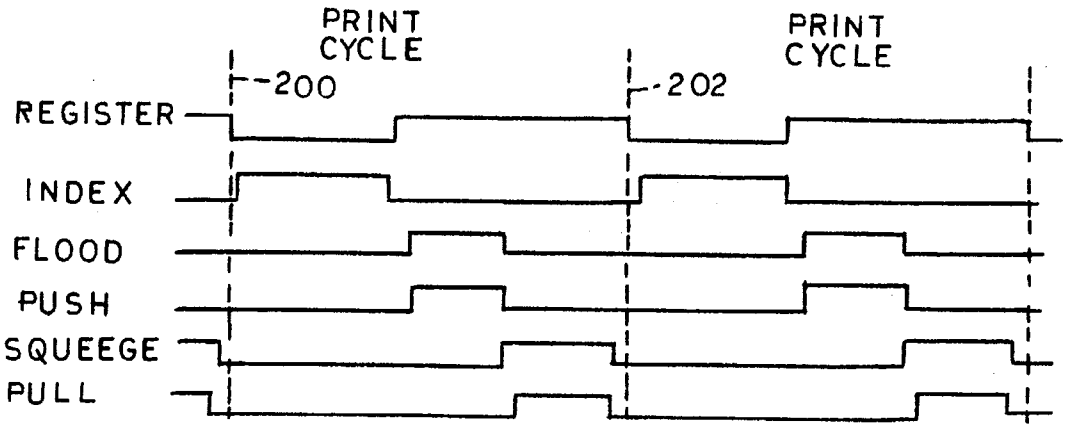
FIG. 4 is a sequential timing diagram of control signals produced in the control of the apparatus of FIG. 1.
Figure 5:
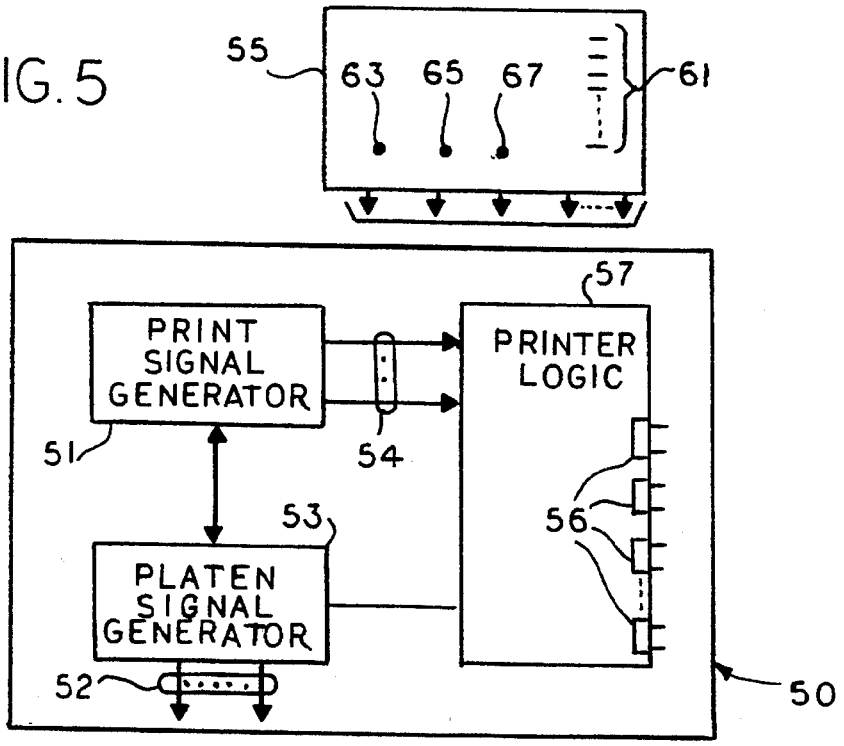
FIG. 5 is a functional block diagram of a control unit for generating the signals of FIG. 4.

Control unit 50 includes a platen move signal generator 53 which generates the signals "register" and "index" shown in the first two lines of FIG. 4 and a printer signal generator 51, which generates the signals "flood", "push", "squeegee" and "pull" shown in the last four lines of FIG. 4. A print cycle begins at dotted line 200 of FIG. 4 when the register signal from platen signal generator 53 drops from the active state to the inactive state, which removes air pressure from cylinders 206 allowing the turntable 16 to lower. When turntable 16 has lowered, the signal index (FIG. 4) goes active to energize indexer 211 to index turntable 16 by one increment (36°). At the conclusion of the index operation, the signal "register" again becomes active raising turntable 16 into the locked position. While turntable 16 is in the locked position, printer signal generator 51 generates an active "flood" signal which lowers flood bar 106. Next, the signal "push" from printer signal generator 51 goes active to move the lowered flood bar 106 from its left most position (FIG. 3) to its right most position. At this time, both signals "flood" and "push" become inactive and the signal squeegee becomes active, raising flood bar 106 and lowering squeegee 108. After squeegee 108 is lowered, the signal "pull" goes active which pulls the lowered squeegee to the left across the printing screen 47. When squeegee 108 is in its left most position the "squeegee" and the "pull" signals go inactive and turntable 16 is lowered by the falling of the "register" signal at dotted line 202. After the lowering of turntable 16, the next print cycle begins with the indexing to a new position and the previously described registration and printing control signals. The signals from platen signal generator 53 are connected to associated gas pressure valves by a plurality of conductors 52 and the signals from printer signal generator 51 are connected via a plurality of conductors 54 to a printer logic arrangement 57.

Printer logic arrangement 57 includes a number of output ports 56 equal to the number of stations around the printer apparatus. In the present example, printer logic 57 includes ten output ports 56 each of which is uniquely associated with one of the stations 1 through 10. The function of printer logic 57 is to selectively connect signals from printer signal generator 51 to the print heads located at the stations 1 through 10. The selective connection provided by printer logic 57 permits individual print heads to be turned off or on, to provide a controlled method of printer stopping and starting and to inhibit the printing process for a given platen without stopping the entire printing operation.

The printing apparatus of the present embodiment includes a control panel 55, which is physically located at or near input station 10 of the printing apparatus. Control panel 55 is electrically connected to printer logic 57 of control unit 50 to provide operator interaction with printing functions. Control panel 55 has a number of two position switches 61 equal to the number of print stations. Each switch. 61 is associated with one of the stations 1 through 10, and depending on its state, can semi-permanently inhibit the transmission of printer control signals to the associated station. In the apparatus of FIG. 1, the switches corresponding to stations 3, 6, 9 and 10 will be set to the inhibit position, since no print heads are at these stations, and accordingly, no printer control signals are needed thereat. If print head 15 at station 4 is not to print, then its associated switch 61 could be set to the inhibit position to inhibit printing at station 4. All switches 61 which are associated with active print heads will be set to the non-inhibit position to normally transmit the print control signals (FIG. 4) from print signal generator to the associated print head 15.

Control panel 55 also includes a stop button 63, a start button 65 and a skip button 67, all of which cooperate with control unit 50 to selectively inhibit the transmission of print control signals in a transitory manner. For example, skip button 67 is pressed by an operator when a platen which is not to be printed e.g., an empty platen, is rotated toward the print heads. Pressing the skip button inhibits each print head in sequence around the printer in synchronism with the position of the platen to be skipped.

Figure 6:
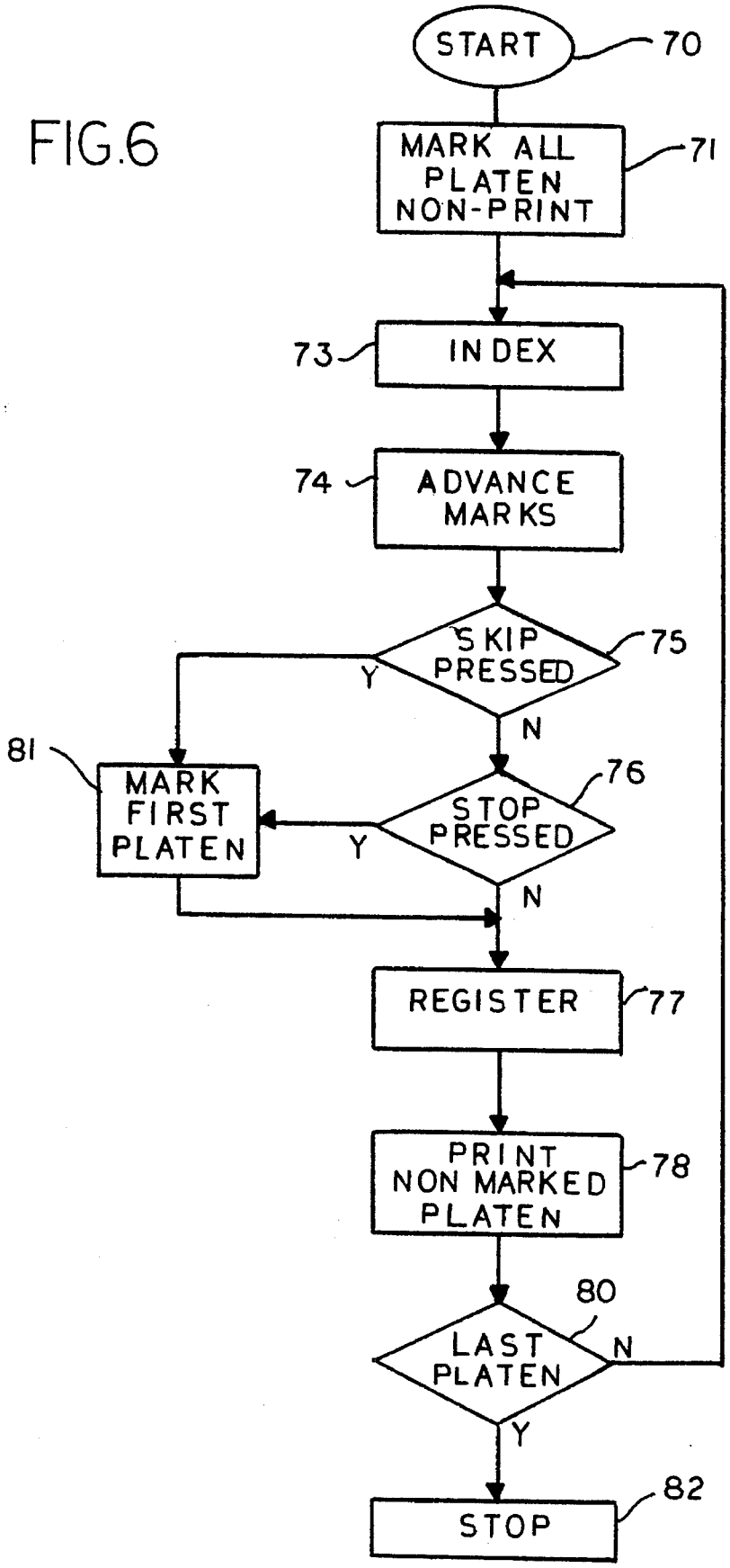
FIG. 6 is a flow diagram of the operation of the control unit of FIG. 5.

FIG. 6 is a flow diagram of the function of control unit 50 in response to the pressing of buttons 63, 65 and 67 and is first described in conjunction with the start function which is initiated by pressing start button 65. During normal printer operation, all active print heads 15 receive print control signals substantially simultaneously. During start up many platens 160 will not be carrying objects to be printed and printing on those platens would be improper. The automated start up of the present apparatus enables only the print head 15 at station 1 during the first print cycle, then enables the print head at stations 1 and 2 during the second print cycle, and increases the number of printing print heads by one during each successive print cycle until all print heads have been activated. This is not a simple task, since the platens continue to move and the association between platens and print stations changes with each print cycle. Printer logic 57 includes internal storage and logic which maintains a record of the status of platens and their association with print stations during each cycle and updates that association and status when the platens are indexed. The logic and storage provided by control unit 50 is that of the previously mentioned Omron programmable logic controller. However, the logic and storage may comprise latching relays and logic or other types of digital storage and control circuitry.

Figure 7:
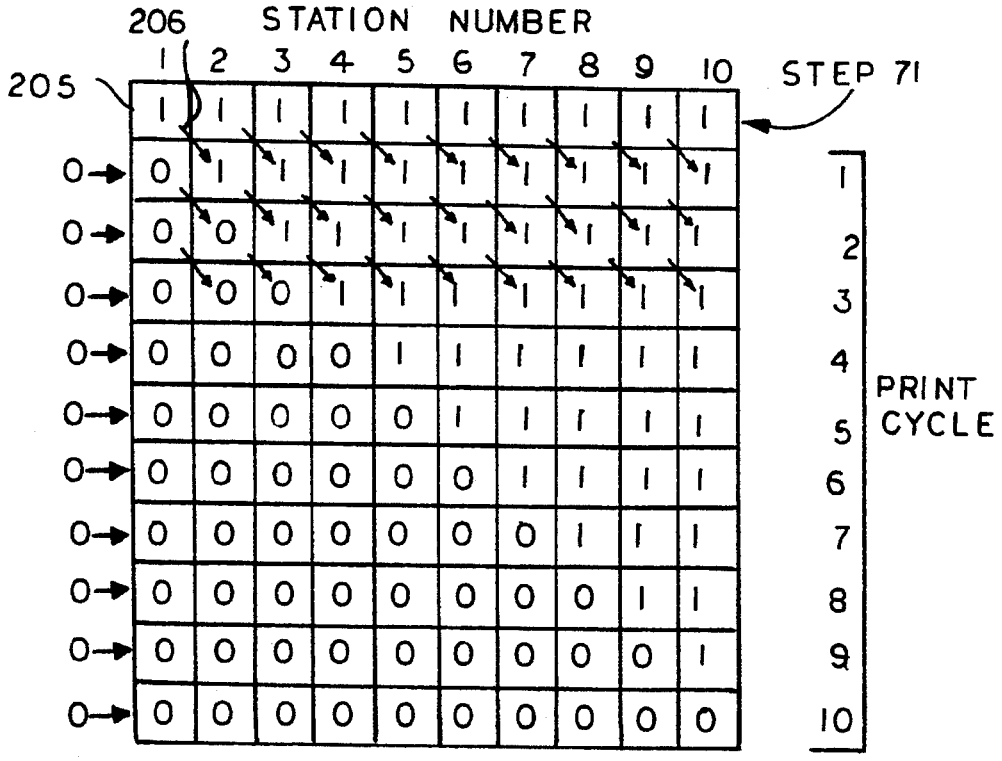
FIG. 7 is a functional representation of the control of print head inhibit signals in the performance of a start function.

The start function is described in conjunction with FIG. 7 which represents how platens are marked for non-printing and how the association of platens and print stations is updated during each print cycle. FIG. 7 shows an elongated rectangle 205 which is comprised of ten storage locations, one for each platen 160 in the system. Each elongated rectangle beneath 205 represents the status of the platens during successive print cycles 1 through 10. Each column of the block of storage locations in FIG. 7 is labeled with a station number which denotes the association of stations 1 through 10 with the various storage location columns. In FIG. 7, the left most storage area is associated with station 1, the next with station 2, through the sequence until the right most storage area is associated with station 10. In the present embodiment, any station associated with a storage location having a logic 1 non-print mark will be selectively inhibited from receiving printer control signals while a station associated with the storage location storing a logic 0, will be enabled to receive printer control signals. Should a station be inhibited from receiving print control signals by one of the switches 61, no print control signals will be sent to that station regardless of the stored values shown in FIG. 7.

The start sequence begins in block 70 of FIG. 6, when an operator places an object to be printed on the platen at input station 10 and presses start button 65. In response to the press of start button 65, step 71 is performed where a logic 1 non-print mark is stored in all ten storage locations as shown in elongated rectangle 205. Next, an index step 73 is begun in which the turntable 16 is indexed one step counterclockwise to rotate all platens 160 to the next station. After the index step is started, a block 74 is performed to advance the stored logic 0 and logic 1 marks to associate them with the next stations. The advancement of marks, which is represented by small diagonal arrows, e.g., 206, in the lower right-hand corner of each storage location, consists of shifting all marks one station to the right and storing a logic 0 in the left most (station 1) storage location. This movement of the contents of storage locations simulates the movement of platens relative the print stations and associates the inhibit marks appropriately for the first print cycle which is performed when the platen at input station 10 is indexed to station 1. The first storage location normally receives a logic 0 signal to enable printing on the platen it represents. During the skip and stop functions however, a logic 1 is stored in the first location as discussed below.

After the non-print marks are advanced to the positions shown in the second row of FIG. 7, a logic 0 enable signal is stored in the left most location (station 1) and the logic 1 inhibit signal formerly in the station 10 location of the first row has been discarded. Since only the left most location corresponding to station 1 includes a logic 0, only the printer 15 at station 1 will receive print control signals from printer logic 57 during the first print cycle. After the marks are advanced, steps 75 and 76 which relate to skip and stop functions are performed. After steps 75 and 76, which are described later, the flow proceeds to register step 77. In register step 77, the turntable is raised in preparation for printing and the flow proceeds to a step 78 where all non-inhibited stations are permitted by printer logic 57 to receive printer control signals from printer signal generator 51. In the present example, stations 2 through 10 are inhibited by the stored information represented in the print cycle 1 and station 1 is not inhibited. Accordingly, only the printer 15 at station 1 will print in response to print control signals.

After step 78, a step 80, which is a part of the stop function, is performed to determine if the last platen has been printed. In the present example, the last platen has not been printed and the flow returns to index step 73 to again rotate the platens. After indexing, the stored inhibit marks are advanced from the value shown in the second row to the values of the third row of FIG. 7. This prepares printer logic for the second print cycle. When print step 78 is performed in the second cycle, printer logic 57 stores the information shown in row 3 which indicates that both the first and second stations should receive print control signals while all other stations should be inhibited from receiving print control signals. The print cycles continue as above described, each print cycle printing only those non-inhibited stations and advancing the marks in preparation for the next print cycle. During the tenth print cycle following the pressing of the start button 65, the start procedure is over in that all platens have objects to be printed and, through successively advancing the inhibit marks in synchronism with indexing, no storage location includes a logic 1 inhibit mark. During normal operation, the system continues to function without inhibit marks for platens, and all printing stations will receive printer control signals during each printing cycle.

From time to time, it will be desirable to skip the printing of a given platen all the way through the ten stations of a printing operation. Skip button 67 is provided to enable this function. The skip function is discussed with regard to the flow diagram of FIG. 6 and to the logic and storage representation of FIG. 8. In the present example, it is assumed that the apparatus is operating in the normal printing mode in which all available print heads 15 are enabled during each print cycle. In this mode, all platen representing storage locations store an enable signal shown in FIG. 8 as a logic 0. After the beginning of the index block 73, a determination is made (block 75) whether the skip button 67 has been pressed. When block 75 determines that the operator pressed the skip button, flow proceeds to a block 81 in which the left most storage location (station 1) is marked with a logic 1 inhibit signal as shown in row 1 of FIG. 8. Thereafter, the platens are registered in block 77 and the print step 78 begins. In print step 78, only those stations associated with a non-inhibited platen are printed.

Accordingly, during the first print cycle after the pressing of the skip button, printing at station 1 will be inhibited while the 7printing at other stations is permitted. After printing, the platens are indexed (block 73) and, in block 74, the platen representations stored by the storage locations are advanced as shown by the arrows 206 in FIG. 8. The new association of platens and print stations is represented in row 2, in which stations 1 and 3 through 10 are not inhibited, while station 2 is inhibited from printing. As each print cycle is carried out, the advancement of the inhibit mark (block 74) which simulates the movement of the non-print platen successively inhibits print heads about the apparatus in synchronism with the movement of the platen which was at the input station when the skip button 67 was pressed. After the tenth print cycle since the skip button was pressed, the logic 1 inhibit signal is advanced from the memory representation of FIG. 8 leaving all print stations available for printing.

FIG. 9 represents the function performed by control unit 50 when the stop button is pressed. Pressing the stop button sequentially inhibits printing on platens beginning a printing revolution so that objects in the apparatus will be printed and empty platens can enter the apparatus behind them without being printed. This example is described in terms of the flow diagram of FIG. 6 and the logic and storage representation of FIG. 9. Pressing the stop button is detected in block 76 of FIG. 6 and the flow proceeds to block 81 where a logic 1 inhibit mark is stored with regard to the platen leaving the input station 10. After block 81, the apparatus is registered in block 77 and printing heads 15 are enabled and inhibited in accordance with the first print cycle line of FIG. 9. In block 80, a determination is made as to whether the last platen has been printed. Block 80 delays the actual stopping of the apparatus for ten print cycles after the stop button is pressed so that all objects on platens can be printed before the rotation of the machine is stopped.

Once the stop button 63 is detected, each subsequent cycle is performed as if the stop button were held in the pressed state. Accordingly, inhibit signals continue to be written into the input platen representing storage location of FIG. 9 and advanced toward station 10 as shown. Block 80 recognizes when the tenth print cycle, after the pressing of the stop button occurs, and directs control to the stop step 82 in which further indexing of the apparatus is terminated. After performance of the stop 82, the apparatus can again be started by pressing the start button.

The preceding description of FIGS. 7 through 9 represents that platen enable/inhibit marks are stored by control unit 50 and that the representations are reassociated with different print stations before each print operation. Other storage and association advancement methods could also be used to provide the necessary control functions. For example, the storage locations could all comprise separated memory elements in a digital computer memory and the advancement could be performed by indexing through the various locations. The functions represented in FIGS. 7 through 9 could also be performed by relay logic and the latching relay shift registers to provide the necessary storage.

While a preferred embodiment of the invention has been illustrated, it will be obvious of those skilled in the art that various modifications and changes may be made thereto without departing from the scope of the invention as defined in the appended Claims.

What is claimed is:

1. A screen printing apparatus for printing multiple impressions on each of a plurality of work objects in a predetermined sequence comprising:

a plurality of platens for conveying said work objects;

an input station at which work objects are places on said platens;

a plurality of print stations, each for printing an impression on each work object presented thereto;

means for moving said platens from said input station to said print stations in said predetermined sequence;

means for identifying at least one of said platens as a non-print platen; and control means responsive to said non-print platen identification for inhibiting printing on said at least one non-print platen by each of said print stations, wherein said control means comprises:

means for storing a non-print representation corresponding to each of said identified non-print platens;

means responsive to the movement of said platens for associating each of said non-print representations with successive ones of said print stations in said predetermined sequence; and means responsive to said non-print platen representations for inhibiting printing at the print station associated therewith.

2. The apparatus of claim 1 wherein each of said print stations is responsive to print control signals from said control means and said control means further comprises means responsive to the identification of said at least one non-print platen for selectively inhibiting the transmission of said print control signals to said print stations.

3. The apparatus of claim 2 wherein said moving means indexes said platens from said input station to said print stations in incremental steps and wherein each of said print stations is a different, predetermined number of said incremental steps from said input station than the others of said print stations; and said control means comprises means responsive to the number of incremental steps occurring after said non-print platen identification for selectively inhibiting said print control signals.

4. The apparatus of claim 3 wherein said predetermined sequence of print stations comprises a first print station and said identifying means comprises a platen skip signaling means for generating platen skip signals and means responsive to said platen skip signals for identifying a platen moving from said input station to said first print station as a non-print platen.

5. A screen printing apparatus in accordance with claim 1 wherein said means for identifying comprises a switch means responsive to human operator interaction for identifying at least one of said platens as a non-printing platen.

6. A screen printing apparatus for printing multiple impressions on each of a plurality of work objects in a predetermined sequence comprising:

a plurality of platens for conveying said work objects;

an input station at which work objects are placed on said platens;

a plurality of print stations, each for printing an impression on each work object presented thereto;

means for moving said platens from said input station to said print stations in said predetermined sequence wherein each platen is presented to said input station after presentation to a last print station of said predetermined sequence;

means for identifying at least one of said platens as a non-print platen;

control means responsive to said non-print platen identification for inhibiting printing on said at least one non-print platen by each of said print stations;

start signaling means; and means responsive to the actuation of said start signaling means for identifying all of said plurality of platens to be non-print platens and means for deleting the identification of each of said non-print platens after said last print station.

7. A screen printing apparatus for printing multiple impressions on each of a plurality of work objects in a predetermined sequence comprising:

a plurality of platens for conveying said work objects;

an input station at which work objects are placed on said platens;

a plurality of print stations, each for printing an impression on each work object presented thereto;

means for moving said platens from said input station to said print stations in said predetermined sequence;

means for identifying at least one of said platens as a non-print platen;

control means responsive to said non-print platen identification for inhibiting printing on said at least one non-print platen by each of said print stations; and a plurality of operator settable print control switches, each associated with a unique one of said plurality of print stations, wherein said control means is responsive to the setting of said switches, regardless of said non-print platen identification, for selectively inhibiting said print stations.

8. A method of controlling screen printing apparatus comprising an input station, a plurality of print stations and a plurality of work object conveying platens incrementally moved from said input station to said print stations in a predetermined sequence, said method comprising:

generating, by a control unit, synchronized incremental platen move signals and print control signals;

printing by ones of said print stations receiving said print control signals;

storing a representation of at least one of said platens as a non-print platen;

associating, responsive to the incremental movement of said platens, said at least one non-print platen representation with successive ones of said print stations in said predetermined sequence and in synchronism with the incremental movement of said platens; and inhibiting print stations associated with said at least one non-print platen representation from receiving said print control signals.

9. The method of claim 8 wherein said platens are incrementally moved from a last print station of said predetermined sequence to said input station and said method comprises deleting the non-print platen representation of each platen after movement from said last print station.

10. The method of claim 9 wherein said apparatus comprises a start signal generating means and said storing step comprises storing non-print platen representations for all of said platens responsive to start signals from said start signal generating means.

11. The method of claim 8 wherein said apparatus comprises a stop signal generator for generating stop signals and said storing step comprises storing, responsive to said stop signals, a non-print platen representation for each of said platens upon their incremental movement from said input station.

12. The method of claim 8 wherein said apparatus comprises skip signal generating means and said storing step comprises storing, responsive to skip signals from said skip signal generating means, a representation of the platen between said input station and a first station of said predetermined sequence as a non-print platen.

13. A method in accordance with claim 8 wherein said screen printing apparatus comprises a non-print switch and said storing step comprises storing, responsive to human operator interaction with said non-print switch, a representation of at least one of said platens as a non-print platen.

* * * * *